United States Patent [19]

Ritsch

[11] Patent Number: 4,854,565

[45] Date of Patent: Aug. 8, 1989

[54] CLAMPING DEVICE

[75] Inventor: Ingomar Ritsch, Hopfgarten, Austria

[73] Assignee: Bessey & John GmbH & Co., Fed. Rep. of Germany

[21] Appl. No.: 252,040

[22] Filed: Sep. 30, 1988

Related U.S. Application Data

[63] Continuation of Ser. No. 62,515, Jun. 16, 1987, abandoned.

[30] Foreign Application Priority Data

Jun. 16, 1986 [AT] Austria ..... 1619/86

[51] Int. Cl.[4] ..... B25B 5/14

[52] U.S. Cl. ..... 269/41

[58] Field of Search ..... 269/41, 42, 82, 152, 269/153, 154, 155, 237–239, 286

[56] References Cited

U.S. PATENT DOCUMENTS

| | | | |
|---|---|---|---|
| 371,349 | 10/1887 | Newell | 269/42 |
| 1,047,519 | 12/1912 | Haskell . | |
| 3,888,476 | 6/1975 | Barton | 269/41 |
| 4,023,787 | 5/1977 | Violette | 269/41 |
| 4,061,321 | 12/1977 | Farr | 269/41 |
| 4,236,703 | 12/1980 | Stevenson | 269/41 |
| 4,555,100 | 11/1985 | Ditto | 269/286 |

*Primary Examiner*—Robert C. Watson

*Attorney, Agent, or Firm*—Leydig, Voit & Mayer

[57] ABSTRACT

A clamp for holding elongated workpieces in angular abutment with each other includes a base, a first pair of clamping jaws formed by two sides of an angular member, the sides defining between them an angle and an angular sector, a guide on the base for guiding displacement of the angular member on the base along a line bisecting the angle, a lock for locking the angular member on the base, a clamping member displaceable relative to the base along a line parallel to the line bisecting the angle, a pair of first and second levers pivotally coupled to each other at one end of each lever, the first lever being pivotally coupled to the base at an end opposite the second lever and the end of the second lever opposite the first lever being pivotally coupled to the clamping member, and a second pair of clamping jaws, each pivotally connected to one of the pair of first and second levers.

9 Claims, 3 Drawing Sheets

CLAMPING DEVICE

This application is a continuation of application Ser. No. 062,515 filed June 16, 1987 now abandoned.

BACKGROUND OF THE INVENTION

The invention relates to a device for clamping workpieces to be placed at an angle to one another, comprising a clamping element having a clamping member longitudinally displaceable along the axis of angle symmetry, and two pairs of clamping jaws, one pair being adapted to engage the inner sides of workpieces and being provided on an angle piece lockably guided along the axis of angle symmetry on a base plate and the other pair of clamping jaws being adapted to engage the outer sides of workpieces and being articulatedly joined to guide levers each articulatedly connected on the one hand to the base plate and on the other hand via a connecting bar to the clamping member, the levers moving each clamping jaw along a circular arc during actuation of the clamping element, the workpieces hereby being grasped between the clamping jaws and pressed against one another.

A known device of this type discloses a miter clamp, in which all the constructional parts, with the exception of the angle piece, are located outside the angle formed by the workpieces to be clamped. This means that the guide lever bearing axes, which are fixed in relation to the frame, are arranged externally of the workpieces and so the force component of the clamping jaws acting at right angles to the miter face will become less and less the closer the clamping jaws get, due to their displacement in a circular arc, while the wedge effect of the angle piece remains the same. An optimum clamping force will therefore be exerted only in an extremely limited area and a very exact setting for the opening width, dependent on the width of the workpieces, is required.

SUMMARY OF THE INVENTION

The object of the invention is therefore to provide a device of the type described at the outset, in which the approach of the clamping jaws towards one another increases the clamping force components acting at right angles on the abutting faces of the workpieces.

This is accomplished in accordance with the invention in that the bearing axis of each guide lever of the pair of clamping jaws adapted to engage the outer sides of workpieces is arranged within the area of the base plate defined by the workpieces.

Workpieces placed against one another at an angle, for example frame borders, extend convexly when seen from a viewpoint within the angle. Due to the arrangement of the bearing axes within the angle the circular arcs, along which the clamping jaws for engaging the outer sides of the workpieces move, are also convex when seen from the same viewpoint. This means that the directions for the movement of the clamping jaws towards one another and for the movement of the workpieces to be clamped such that they are pressed together are similar. It has also been shown that the inner angle piece need not correspond to the interior angles of the workpieces. In an extreme case, even a cylindrical "angle piece" can also be provided. Before the workpieces are clamped in place, the angle piece bearing or forming the clamping jaws engaging the inner sides of the workpieces can be displaced along the axis of angle symmetry into a position which enables the workpieces to be clamped to be accommodated in a loosely fitting manner. Once the angle piece is fixed in position and the workpieces have been inserted, the clamping element is actuated and this element displaces the clamping member along the axis of angle symmetry and brings the clamping jaws engaging the outer sides of the workpieces closer together via the connecting bar. Their movement along the circular arc initiates the pressing force required to press the two workpieces together, whereby the force component acting at right angles to the axis of angle symmetry is increased. Since the workpieces should not slip through along the contact faces of the clamping jaws engaging the outer sides of the workpieces but must, however, slide along the contact faces engaging the inner sides of the workpieces, preferred embodiments can provide friction-increasing coverings on the clamping jaws engaging the outer sides of the workpieces and friction-decreasing coverings on the clamping jaws engaging the inner sides of the workpieces. Particularly suitable as friction-increasing coverings are rubber-like coverings having a Shorehardness of between 30 and 60 and preferably a Shore hardness of 40.

In order to open the device, the angle piece is released and displaced along the axis of angle symmetry which neutralizes clamping of the workpieces as well as contact pressure on the miter faces. In this respect, the miter faces are subjected to, at the most, minimal tensile loads and so the freshly adhered workpieces can already be removed after a minimum period of time.

For actuating the clamping member, a screw spindle which is customary in clamps can be provided. The handle of this screw spindle is preferably provided externally in relation to the workpieces. The clamping element could, however, also be provided in the form of a locking handle which is pivotally mounted on the angle piece and to which the clamping member is articulated. In both embodiments, the clamping member and the angle piece can, during actuation, be displaced together on the base plate, whereby they are also displaced relative to one another due to lever transmission. It is, however, preferable for the clamping to be arranged on the base plate so as to be adjustable independently of the displaceable angle piece.

The angle piece can be fixed in position on the base plate by, for example, a setscrew, a clamping toggle or by canting a spring biased slide member. It is also conceivable to provide the inner clamping jaws such that they are spring-biased on the angle piece and limitedly displaceable along the axis of angle symmetry.

BRIEF DESCRIPTION OF THE DRAWINGS

In the following, the invention will be described in greater detail on the basis of the attached drawings.

Figure 1:
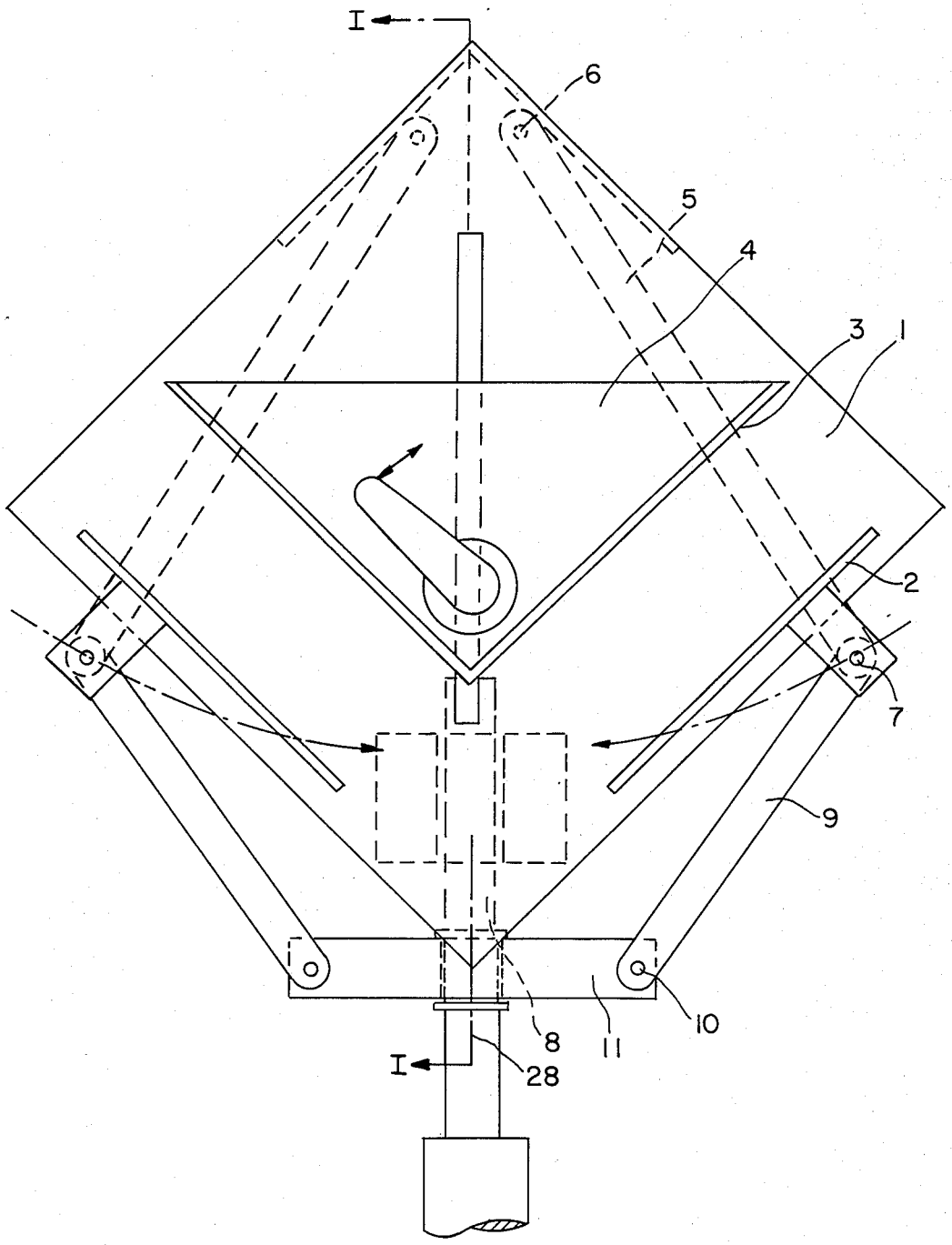
FIG. 1 shows a plan view of a clamping device according to the invention and FIGS. 2 and 3 show cross sections two different embodiments of the invention, both taken along the line I—I in FIG. 1.
Figure 2:
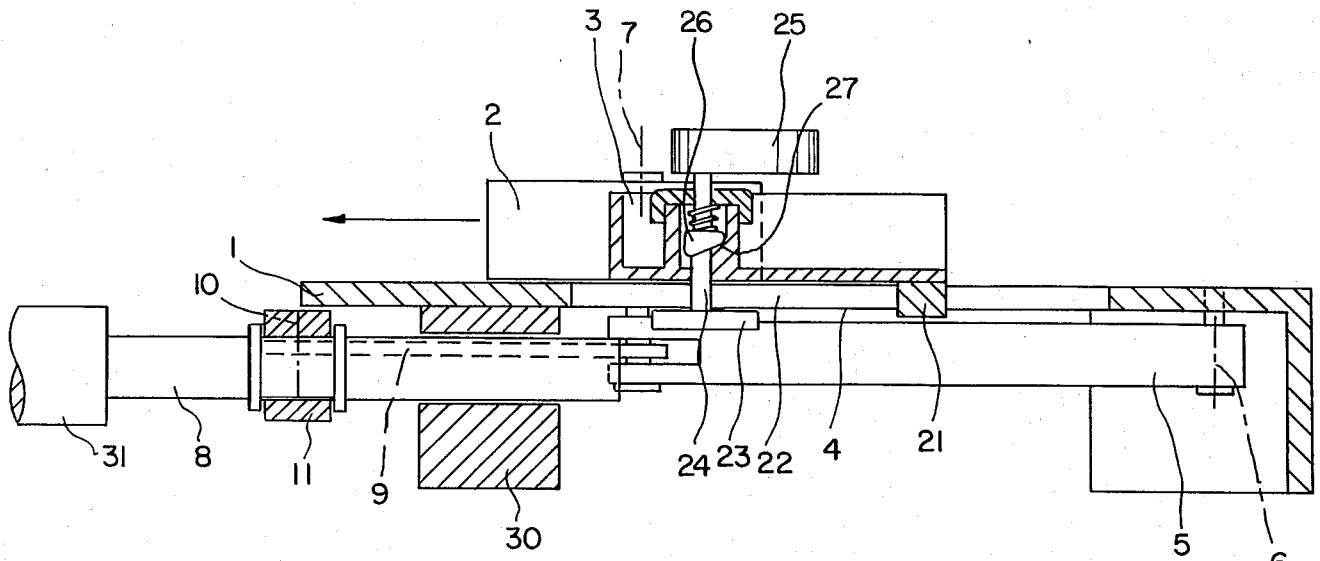

The device has, according to FIGS. 1 and 2, a base plate 1 of any optional shape, on which two supporting areas are defined for workpieces which are to be placed against one another at an angle, in particular at right angles, for example frame borders or the like, by means of pairs of clamping jaws 2, 3. A clamping member 8 formed by a screw spindle is arranged so as to be adjustable along the axis of angle symmetry 28 and is actuated by means of a handle 31.

The screw spindle engages in a threaded block 30 which is fixed in position on the base plate 1 and guides a transverse web 11 mounting two bearings pins 10 symmetrically spaced from the axis of angle symmetry 28. Connecting bars 9 are arranged on these pins and are supported at their second ends on bearing pins 7 which are provided on the ends of guide levers 5 and on which the pair of clamping jaws 2 engaging the outer sides of the workpieces are also pivotally mounted. The guide levers 5 are, for their part, articulated on bearing pins 6 which are spaced from the axis of angle symmetry 28 and project in the region of the side of the base plate 1 remote from the transverse web 11. A rotation of the handle 31 displaces the clamping member 8 according to the respective direction of rotation and moves each of the clamping jaw bearing pins 7 along a circular arc. They move towards the axis of angle symmetry 28 (arrow, FIG. 1) when the transverse web 11 is drawn away from the threaded block 30. The second, inner pair of clamping jaws 3 is formed by an angle piece 4 which is displaceable along the axis of angle symmetry 28 and capable of being fixed on the base plate 1 in any optional position by a clamping means. The base plate 1 has for this purpose a longitudinal slot 22 penetrated by a pin 24. This pin 24 engages the base plate 1 underneath by means of a set-screw 23 and has at its upper end a control handle 25. The pin 24 also bears a wedge-shaped member 26 which is pressed against a projection 27 by a spring encircling the pin 24. Rotation of the handle 25 therefore presses the setscrew 23 onto the underside of the base plate 1 or releases it therefrom. Longitudinal guidance of the angle piece 4 may be achieved by one or more guiding webs 21 which engage in the slot 22 in the base plate 1. This is not, however, absolutely necessary.

If two workpieces are inserted between the open clamping jaws 2, 3 the angle piece 4 may be displaced and the clamping jaws 2 engaging the outer sides of the workpieces may be moved closer together to bring the clamping jaws 2, 3 into loose contact with the workpieces.

The angle piece 4 can now be secured in position and the clamping member 8 moved by means of the handle 31 to cause the clamping jaws 2 engaging the outer sides of the workpieces to grasp and increasingly clamp the workpieces and press them against one another. The force component acting at right angles to the axis of angle symmetry, and therefore to the miter faces, increases the closer the clamping jaws engaging the outer sides of the workpieces are to one another. The workpieces which have been pressed together are removed in that clamping of the angle piece 4 is released and this piece displaced towards the back so that any tensile load which would counteract the contact pressure and be exerted by the clamping jaws 2 on the adhered workpieces is eliminated as much as possible. In one variation, the transverse web 11 may be provided with the internal thread, which the screw spindle engages, the screw spindle itself being mounted on the block 30 connected with the base plate so that it cannot be axially displaced.

Figure 3:
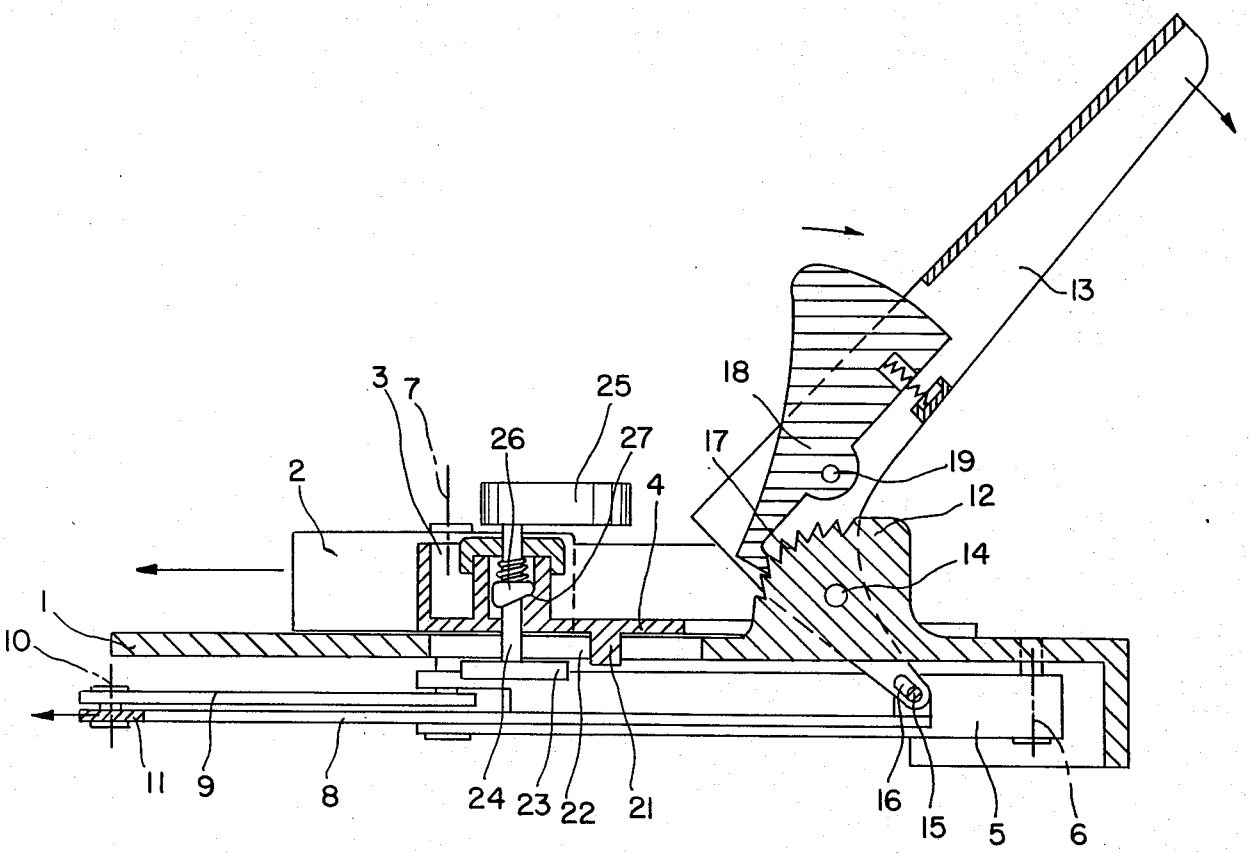

In the embodiment of FIG. 3, the clamping member 8 is moved via a locking handle 13 which is pivotable about an axis 14 extending parallel to the base plate 1. The locking handle 13 forms a twin-armed lever, the free end of which serves as a handle portion and the second end of which protrudes through the base plate 1 and has a slot 16 penetrated by a pin 15 arranged on the end of the clamping member 8. In the locking handle 13, a spring-loaded detent 18 is pivotable about an axis 19 and interacts with teeth 17 provided on a bearing block 12 which mounts the axis 14 of the locking handle 13. The bearing block 12 is secured to the base plate 1 so that the angle piece 4 is displaceable independently of the locking handle 13 along the axis of angle symmetry 28. The pair of clamping jaws 2 engaging the outer sides of the workpieces is not therefore altered in direct relation to the pair of clamping jaws engaging the inner sides of the workpieces. The workpieces are clamped in the same manner as in the embodiment of FIG. 2 by displacing the angle piece 4 and securing it in a take-up position dependent on the width of the workpieces. Contact pressure is again counteracted by releasing the angle piece 4 and causing it to move to the back, whereby the miter faces are subjected to practically no tensile load.

The contact faces of the pair of clamping jaws 3 engaging the inner sides of the workpieces are preferably provided with a slide covering, those of the pair of clamping jaws 4 engaging the outer sides of the workpieces with a friction-increasing covering, for example of rubber-like material. In a further, possible construction it would also be conceivable to provide the pair of clamping jaws 3 engaging the inner sides of the workpieces with a slight elastic resilience and arrange this pair of jaws as an additional part on the angle piece 4 or have the pair of jaws arranged so as to be elastically resilient relative to the base plate 1. In particular when the pair of clamping jaws 2 engaging the outer sides of the workpieces are provided with friction-increasing coverings, it is possible to press the workpieces together over their entire surface even if the miter cuts do not correspond exactly to the angle since the force component acting at right angles to the axis of angle symmetry is greater than that acting on the clamping jaws engaging the inner sides of the workpieces. As tests have shown, the clamping force between the clamping jaws 2, 3 is considerably less so that in this case the workpieces do not have contact with the clamping jaws 3 over their entire surface and the remaining pressure is only linear which leaves hardly any visible impressions on pressure-sensitive materials such as soft wood.

I claim:

1. A clamp for holding elongated workpieces in angular abutment with each other comprising:

a base;

a pair of first clamping jaws for engaging each of the respective first of opposed first and second sides of each of a pair of workpieces in angular abutment, said jaws being two sides of an angular member, said sides of said angular member forming therebetween an angle defining an angular sector;

guide means on said base for guiding displacement of said angular member relative to said base along a line bisecting said angle;

locking means for locking said angular member relative to said base along said line bisecting said angle;

a clamping member displaceable relative to said base along a line parallel to said line bisecting said angle;

actuating means for displacing said clamping member parallel to said line bisecting said angle;

a pair of first and second levers, each lever having opposed first and second ends, wherein each of said respective first levers is pivotally coupled at its first end to said base and pivotally coupled at its second end to the first end of a respective second lever, the respective second ends of said second levers are pivotally coupled to said clamping member, the respective first ends of said first levers are pivotally coupled to said base at separate locations lying within said sector and the respective second ends of said second levers are attached to said clamping member at separate locations; and a pair of second clamping jaws for engaging each of the respective second sides of each of said workpieces, wherein each of said second clamping jaws is pivotally connected to one of the pairs of first and second levers.

2. The clamp of claim 1 including a friction increasing covering disposed on each of said second clamping jaws.

3. The clamp of claim 2 wherein the friction increasing covering comprises a rubber-like material having a Shore hardness of between 30 and 60.

4. The clamp of claim 3 wherein the rubber-like material has a Shore hardness of 40.

5. The clamp of claim 1 including a friction decreasing covering disposed on each of said first clamping jaws.

6. The clamp of claim 1 wherein said respective first ends of said first levers are pivotally coupled to said base at separate locations that are symmetrically disposed relative to said line bisecting said angle.

7. The clamp of claim 1 wherein said respective second ends of said second levers are pivotally coupled to said clamping member at separate locations that are symmetrically disposed relative to said line bisecting said angle.

8. The clamp of claim 1 wherein said clamping means comprises a threaded collar and said actuating means comprises a rotatable threaded shaft journalled to said base, disposed generally parallel to said line bisecting said angle, and threadingly engaging said collar.

9. The clamp of claim 1 wherein each of said second clamping jaws is pivotally connected to one of the pairs of first and second levers at the respective pivotal connection of said first lever to said second lever.

* * * * *